US005640728A

United States Patent [19]

Graebe

[11] Patent Number: 5,640,728

[45] Date of Patent: Jun. 24, 1997

[54] VENTILATED ACCESS INTERFACE AND CUSHION SUPPORT SYSTEM

[76] Inventor: Robert H. Graebe, 7 Persimmon Ridge Dr., Belleville, Ill. 62223

[21] Appl. No.: 560,942

[22] Filed: Nov. 20, 1995

Related U.S. Application Data

[63] Continuation of Ser. No. 128,650, Sep. 30, 1993, abandoned.

[51] Int. Cl.[6] ..... A47C 21/00

[52] U.S. Cl. ..... 5/606; 5/423; 5/726; 5/658; 128/639

[58] Field of Search ..... 5/421, 423, 284, 5/606, 658, 659, 710, 724, 726; 128/639, 736, 721, 722, 723

[56] References Cited

U.S. PATENT DOCUMENTS

| | | | |
|---|---|---|---|
| D. 27,158 | 6/1897 | Burns . | |
| 1,712,391 | 5/1929 | Mausser | 5/469 |
| 2,493,067 | 1/1950 | Goldsmith . | |
| 2,998,817 | 9/1961 | Armstrong . | |
| 3,231,454 | 1/1966 | Williams . | |
| 3,325,799 | 6/1967 | Farris | 128/721 |
| 3,354,476 | 11/1967 | Scales et al. . | |
| 3,428,973 | 2/1969 | Hargest et al. . | |
| 3,446,203 | 5/1969 | Murray . | |
| 3,476,104 | 11/1969 | Davis | 128/639 |
| 3,644,950 | 2/1972 | Lindsay . | |
| 3,653,083 | 4/1972 | Lapidus . | |
| 3,681,797 | 8/1972 | Messner | 5/469 |
| 3,740,777 | 6/1973 | Dee . | |
| 3,757,356 | 9/1973 | Freeman . | |
| 3,870,450 | 3/1975 | Graebe . | |
| 3,928,871 | 12/1975 | Starr | 5/469 |
| 3,940,811 | 3/1976 | Tomikawa et al. . | |
| 3,949,438 | 4/1976 | Scales . | |
| 3,954,100 | 5/1976 | Sem-Jacobsen | 128/639 |
| 4,005,236 | 1/1977 | Graebe . | |
| 4,057,861 | 11/1977 | Howorth . | |
| 4,185,341 | 1/1980 | Scales . | |
| 4,197,837 | 4/1980 | Tringali et al. . | |
| 4,267,611 | 5/1981 | Agulnick . | |
| 4,279,044 | 7/1981 | Douglas . | |
| 4,347,633 | 9/1982 | Gammons et al. . | |
| 4,391,009 | 7/1983 | Schild et al. . | |
| 4,485,505 | 12/1984 | Paul . | |
| 4,528,704 | 7/1985 | Wegener et al. . | |
| 4,529,248 | 7/1985 | Trotman et al. . | |
| 4,541,136 | 9/1985 | Graebe . | |
| 4,583,255 | 4/1986 | Mogaki et al. . | |
| 4,673,605 | 6/1987 | Sias et al. . | |
| 4,722,105 | 2/1988 | Douglas | 5/469 |
| 4,848,350 | 7/1989 | Lee | 128/639 |
| 4,853,992 | 8/1989 | Yu | 5/423 |
| 5,002,336 | 3/1991 | Feber | 5/421 |

FOREIGN PATENT DOCUMENTS

| | | | |
|---|---|---|---|
| 695414 | 6/1964 | Canada | 5/473 |

*Primary Examiner*—Flemming Saether

*Attorney, Agent, or Firm*—Polster, Lieder, Woodruff & Lucchesi, L.C.

[57] ABSTRACT

A support system (A) including a cushion (B) for uniformly distributing the weight of an individual uniformly and further circulating air along the individual's body. The cushion (B) has porosity and air cells (4) which project upwardly from the base (2) and are in communication through the base (2) so that all exist at the same air pressure. The base (2) has apertures (14) between the cells (4). The system includes a distributor (20) beneath the cushion base (2) and a duct (30) which connects to one side of the distributor (20). The distributor (20) has a plurality of blunted pillars (24) which support the cushion (B) above the distributor base (22) and create a distribution and access chamber (F) beneath the cushion base (2). The duct (30) can have a vertical section (34,40) connected to a container (42) for collecting liquids. A blower (D) discharges conditioned air into the distribution chamber (20) through the duct (30). The air escapes through the cushion base apertures (14) between the cells (4) so as to ventilate the surface area of that portion of the individual's body which is against the cushion. A vacuum blower (D) can also be used to reverse the air flow to assist fluid removal from the distribution chamber (20) and to vent odors. Liquid discharged onto the cushion (B) passes through the apertures (14) to the container (42).

24 Claims, 3 Drawing Sheets

VENTILATED ACCESS INTERFACE AND CUSHION SUPPORT SYSTEM

This is continuation application of application Ser. No. 08/128,650, filed on Sep. 30, 1993, now abandoned.

BACKGROUND OF THE INVENTION

This invention relates in general to a support system for the human body and, more particularly, to a support system which distributes the weight of the body uniformly over the area of the body which is in contact with it, yet provides access and ventilation for that area.

The support system is placed between a seat or bed cushion and another seat or bed surface to provide mechanical access to the underside of the cushion. This system accommodates the flow of and collection of patient fluids, e.g., urine, which may seep down through the cushion, as well as the exchange of conditioned air to the patient, naturally or forced by the use of a blower. It also permits access for a channel to run tubing or wiring to the mattress or to the patient.

Access to the underside of a mattress or other cushioning devices that interface with the soft tissue of a person or animal serves several useful purposes. Ventilation of the skin to control excessive perspiration is important to prevent bacteria growth and reduction of tensile strength of the skin. To introduce conditioned air for warming or cooling of the patient's body is important. To have a means to permit the drainage of body fluids away from the tissue interface through the cushion is important to minimize infection, tissue destruction and enhance comfort. To have a means to vacuum away odor in and around the patient and to evaporate moisture collected under the cushion and be able to discharge it in a manner which does not contaminate the room in which the patient resides is also important.

For persons who need physiological monitoring by way of devices residing in or on the surface of the cushion, it is important to be able to route the wiring or tubing under the cushion. Also, it is important to be able to route tubes down through the mattress or seat cushion to facilitate catheter urine collection, installation of intravenous feeding tubes, or the installation of body temperature sensors.

A cellular cushion and mattress system which is porous exists which effectively distributes the weight of the individual who sits or reclines upon it over the entire skin area which is in contact with or against it. This system can use ROHO cushions or other porous cushions and mattresses.

The ROHO cushion has a multitude of highly flexible air cells which project from a common base, and this base contains channels through which the air cells are in communication. When an individual sits or reclines upon such a cushion, the air cells collapse or deform, at least until the air trapped within them reaches a pressure sufficient to resist the weight of the individual. Even though some of the air cells undergo more deformation than others, their interiors all exist at the same pressure, and thus, the cells exert a uniform restoring or supporting force on that much of the individual's body which is in contact with the cushion. Therefore, bony prominences, such as those in the buttocks, or the ears, shoulder blades, elbows or heels if the cushion is a mattress, do not experience any greater pressure than other areas and are less likely to develop decubitus ulcers, more commonly known as bed sores. Cellular cushions having the foregoing characteristics are disclosed in U.S. Pat. Nos. 4,005,236 and 4,541,136 to R. H. Graebe.

While a cellular cushion will substantially reduce the incidence of decubitus ulcers by spreading the weight of an individual supported on it over a large surface area by conforming to that surface area, it may restrict ventilation along the supported region. Some skin disorders require adequate ventilation, and thus, cellular cushions may not be altogether satisfactory for supporting individuals having such disorders.

In intensive care units or trauma centers, it often is critical to be able to warm or cool the temperature of a patient using conditioned forced air flow.

Also, it is desirable when using the ROHO mattress to have access to individual cells in order to measure local pressure changes to evaluate physiological properties of the patient or to measure physical conditions within the cell.

It also is desirable to collect, retain and/or remove body fluids which the patient may discharge onto the cushion. Air flow may or may not be used in conjunction with collecting or removing body fluids.

It further is desirable to have access to the patient through the cushion for installation of catheter urine collection or intravenous feeding tubes or instrumentation sensors. Such devices do not necessarily require air flow.

The present invention resides in a support system that includes a cushion or mattress which distributes its supporting force over a widespread area of the user's body and, further, has means for access to that area for circulating conditioned air along that area, for collection of body fluids from that area, and for physiological monitoring of that area.

These and other objects and advantages will become apparent thereinafter.

DESCRIPTION OF THE DRAWINGS

In the accompanying drawings which form part of the specification and wherein like numerals and letters refer to like parts wherever they occur.

DETAILED DESCRIPTION

Figure 1:
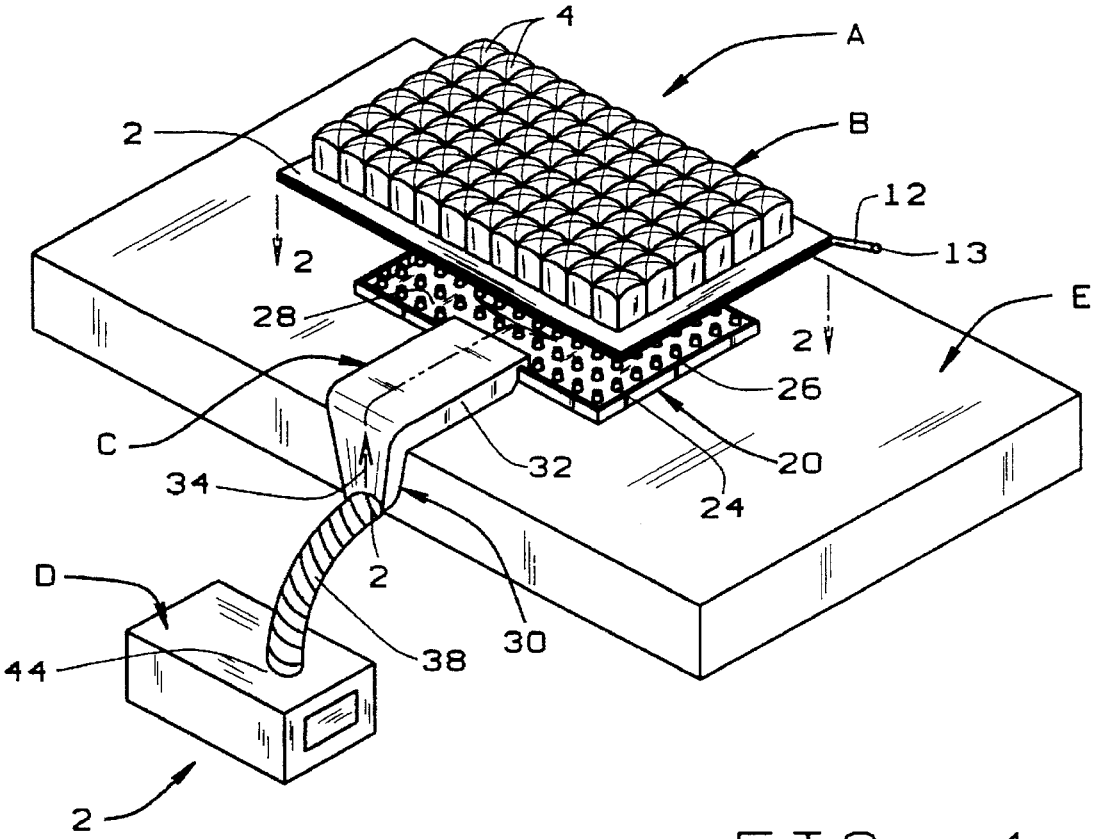
FIG. 1 is a perspective view, partially exploded, showing a ventilated support system constructed in accordance with and embodying the present invention.

Referring now to the drawings, FIG. 1 shows a system A for supporting the human body confortably over extended periods of time while reducing the incidence of decubitus ulcers to a minimum. The system A includes a cellular cushion B, a manifold module C, which lies beneath the cushion B as well as extending outside the cushion periphery, and a blower D for producing a supply of circulating conditioned air which eventually issues from the cushion B to provide ventilation for the region of the supported body that is in contact with the cushion. Both the cushion B and the manifold module C rest on an underlying surface E, with the cushion B extending over, and to a large measure beyond, the module C and in sealing engagement with the surface E for a forced air configuration. If the situation calls for natural ventilation, the module C would be larger or equal to the cushion B. The supporting surface E may be the top surface of a mattress or the top surface of a chair seat. Actually, the manifold module C raises a portion of the cushion B slightly off the underlying surface E, thereby creating an access space F beneath the cushion B. The access space F allows air for ventilation to pass beneath the cushion B and also permits the placement of tubing or wires which may be connected to the cushion B.

Figure 2:
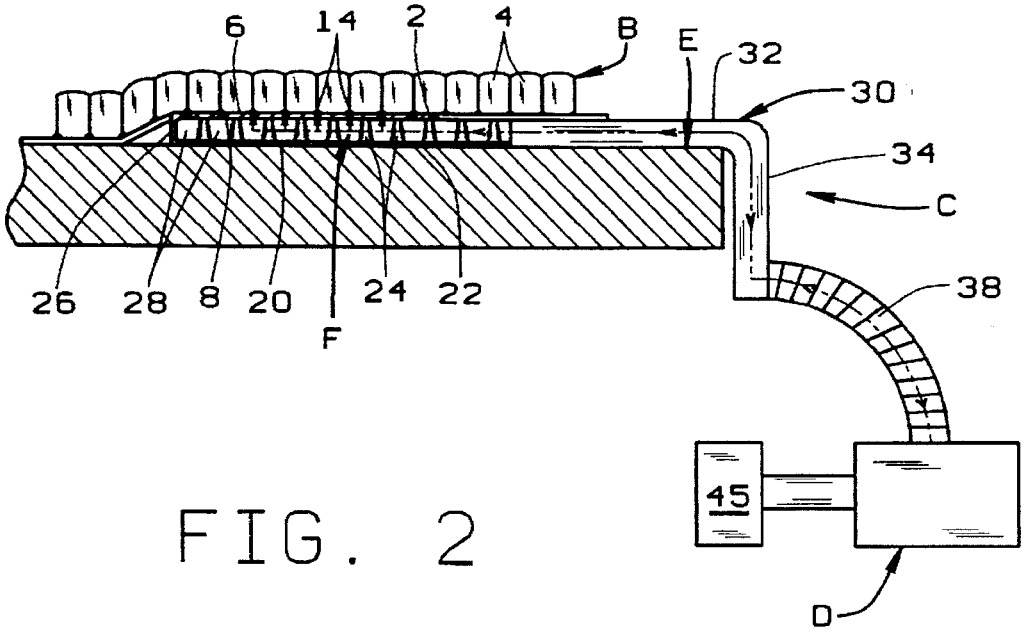
FIG. 2 is a sectional view of the support system taken along line 2—2 of FIG. 1.
Figure 5:
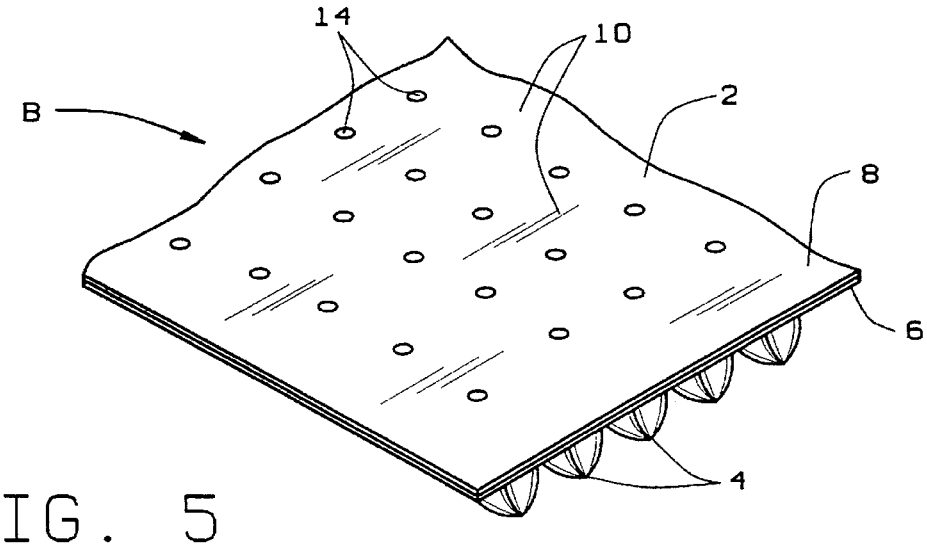
FIG. 5 is a fragmentary perspective view showing the backside of the cushion and the vent apertures in its base.

Considering the cushion B first, its construction and operation are disclosed in U.S. Pat. No. 4,005,236 and 4,541,136 issued to Robert H. Graebe and incorporated herein by reference. In detail, the cushion B includes a base 2 and a multiplicity of air cells 4 which project upwardly away from the base 2 in longitudinal and transverse rows (FIGS. 1 & 2). Both the base 2 and cells 4 are formed from an elastomer and, as such, are quite flexible and thus capable of conforming to surfaces in contact with them. Actually, the base 2 constitutes a laminate formed from an upper sheet 6 and a lower sheet 8 which are joined together along their peripheries to there establish a continuous seal (FIG. 5). The two sheets 6 and 8 are joined elsewhere as well to prevent them from separating. The cells 4 resemble tubes which are attached to and, indeed, formed integral with the upper sheet 6 of the base 2, projecting outwardly away from the sheet 6. At its inner or lower end, the interior of each cell 4 opens through the upper sheet 6 and thus exposes the lower sheet 8. The opposite or remote end of each cell 4, on the other hand, is closed. While the cells 4 are separated from each other at the base 2, the sides of the cells 4 may be fluted so that adjacent cells 4 will expand into and contact each other (FIGS. 1 & 2). When this occurs, the outer ends of the cell 4 form a generally continuous supporting surface which conforms easily to contours in the human body but still permits air or body fluids to pass around the cells to the base 2. In other words, the cushion B is what is called a porous cushion. In addition to the illustrated inflatable cell cushion, the cushion B can be an open cell foam cushion or air arched cell foam cushion as shown in U.S. Pat. No. 4,713,854.

The two sheets 6 and 8 of the base 2 are not only joined together along the periphery of the base 2, but are further joined intermediate the locations at which the cells 4 project from the upper sheet 6. The latter bonds, however, are not so extensive as to completely encircle the ends of the cells 4. On the contrary, they are disrupted, so that interconnecting channels 10 (FIG. 5) exist in the base 2 between the interiors of adjacent cells 4. This places the interiors of all of the cells 4 in communication.

Along its periphery, the base 2 of the cushion B is fitted with an inlet stem 12 (FIG. 1) which leads to the interiors of one of the cells 4 and, of course, is in communication with the remaining cells 4 through the connecting channels 10. The stem 12 contains a valve 13. Through the stem 12, one may inflate the cells 4 of the cushion B simply by blowing air through the stem 12 while its valve 13 is open. The individual for whom the cushion B is inflated then sits or reclines on the supporting surface formed by the upper ends of the cells 4. Next the valve 13 in the stem 12 is opened to allow some of the trapped air to escape, and thus causes the individual to sink further into the cushion B, thereby enabling the surface formed by the upper ends of the cells 4 to better conform to the portion of the individual's body which is against the cushion B. Indeed, enough air should be released to enable the upper ends of the cells 4 that are deflected the most, to come within about one inch of the base 2.

As mentioned, U.S. Pat. Nos. 4,005,236 and 4,541,136 disclose the basic construction of the cellular cushion B in more detail. However, in contrast to the basic cellular cushion, the cushion B has within its base 2 a multiplicity of vent apertures 14 (FIGS. 2 & 5), each of which extends completely through the sheets 6 and 8. The apertures 14 are, of course, offset from the cells 4 themselves, as well as from the channels 10 which connect adjacent cells 4 and, indeed, are confined to the region of the base 2 that lies over the manifold module C. The apertures 14 open into the array of cells 4 between the lower ends of adjacent cells 4 so that air from the access space F of the manifold module C, upon passing through the apertures 14, will flow along the sides of the cells 4 and escape from the cushion B ventilating and conditioning any skin area that is against the cushion B. Like the cells 4, the apertures 14 are arranged in transverse and longitudinal rows, but those rows are offset from the transverse and longitudinal rows of cells 4. In addition, the pitch of the apertures 14 is different from the pitch of the posts 24 to minimize the possibility of occluding the apertures 14 with a post 24. In other words, the openings 14 are not alinged with the posts 24. The air from the module C may be heated or cooled as is necessary. Often in intensive care units (ICU), the need is to warm the trunk of the patient. Therefore the air from the module C is warmed to a temperature necessary to warm the patient.

Figure 3:
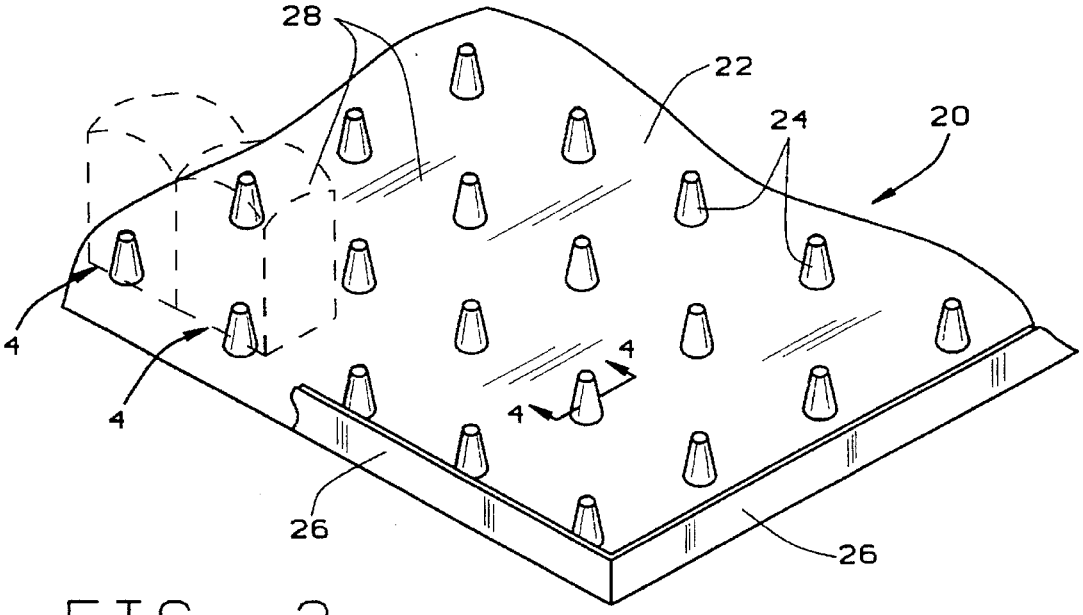
FIG. 3 is a fragmentary perspective view of the distributor which forms part of the manifold module for the support system.
Figure 4:
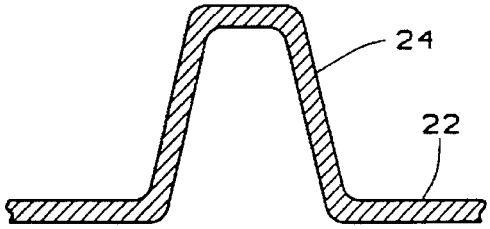
FIG. 4 is a sectional view taken along line 4—4 of FIG. 3 and showing one of the pillars of the distributor.

The manifold module C includes a distributor 20 (FIGS. 1 & 3) which preferably is formed in several pieces which can be snapped together for ease of shipment and packaging. The manifold C also can be a unitary structure. In either event it is formed from a somewhat flexible polymer with a base 22 and shaped post 24 (FIG. 4) projecting upwardly from the base 22. The post 24 can be frustoconical in shape. The base 22 rests on the supporting surface E and, being flexible, generally conforms to the contour of the surface E. The distributor base 22 may be a separate pan, in that, along most of its perimeter, it has a rim 26 which is optional and projects upwardly about as high as the posts 24 to contain collected fluids that may have drained down through the cushion B.

The pan-shaped base 22 possesses the same general configuration as the base 2 of the cushion B, which is normally rectangular, yet is smaller, so that when the cushion B is placed over and centered with respect to the distributor 20, the cushion base 2 will extend beyond the distributor base 22, and, being flexible, will establish a seal with the rim 26 or with the surface E.

The posts 24 project upwardly from the base 22, and when the cushion B is centered over the distributor 20, they likewise bear against the lower sheet 8 on the cushion base 2, thereby elevating that portion of the cushion base 2 beneath which the distributor 20 lies. In effect, the pillars 24 produce within the confines of the rim 26 a somewhat shallow distribution chamber or access space F beneath the base 2 of the cushion B. Being blunted, the ends of the pillars 24 do not puncture or otherwise damage either sheet 6 or 8 of the cushion base 2. Moreover, while the posts 24 are arranged in longitudinal and transverse rows, the spacing between those rows does not correspond to the spacing between the rows of apertures 14 in the base 2 of the cushion B. As a consequence, the posts 24 will never occlude more than a few of the apertures 14.

In addition to the distributor 20, the manifold module C includes an optional supply duct 30 (FIGS. 1 & 2), which leads to one of the edges of the distributor 20, preferably one of the longer edges, and here the rim 26, if used, is disrupted so that the duct 30 opens into the region occupied by the studs 24, which is, of course, the distribution or access chamber F. The duct 30, which is preferably molded from a polymer, includes a horizontal section 32 and a vertical section 34. If the horizontal section 32 is flexible, there is a stud insert 33 positioned inside it which keeps the horizontal section 32 from collapsing (FIG. 2). The duct 30 can be a rigid polymer, such as used in a vacuum cleaner head, which eliminates the need for the stud insert 33.

The horizontal section 32 leads up to the rim 26 of the base 22 and possesses a generally uniform cross-section, it being substantially wider than it is high. Indeed, the lower wall of the horizontal section 32 aligns with and connects to the base 22 of the distributor 20. Here the height of the horizontal section is about the same as the height of the studs 24 and rim 26 so that the duct 30 does not project above them. The cross-sectional area of the duct 30 where it opens into the distribution chamber 26 should be as large as practical.

The horizontal section 32 is long enough to extend to the edge of the underlying surface E and slightly beyond and here the horizontal section 32 merges into the vertical section 34. The upper portion of the vertical section 34 likewise possesses an elongated configuration, but the lower portion is somewhat convergent and tapers down to a flexible hose 38 which connects to a blower or vacuum pump D.

Figure 8:
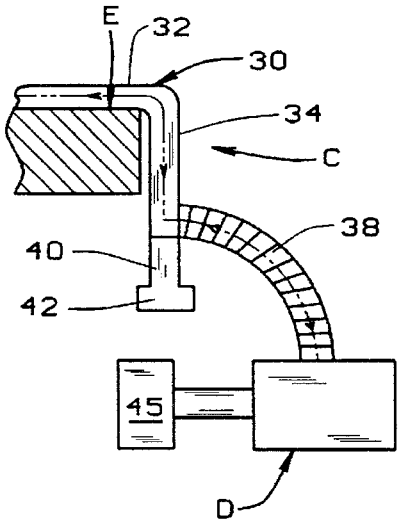
FIG. 8 is a fragmentary sectional view similar to the right portion of FIG. 2 but showing another modification of the invention.

FIG. 8 shows an alternative construction in which a spout 40 is connected to the duct 30 where it joins the hose 38. Connected to the spout 40 is a collection container 42, which optionally is clear. The connection of the spout 40 and container 42 is such that the container 42 may be easily removed and replaced.

The air or vacuum hose 38 leads from the blower D which produces an airstream that it discharges into the hose 38 which, in turn, directs it into the duct 30. The blower D is electrically operated, having a fan powered by an electrical motor, and possesses a filter through which it draws the air that is, thereafter, directed into hose 38.

If desired, air conditioning means 45 for heating or cooling the air is connected in line with the blower D so that conditioned air is delivered to the duct 30.

Operation

The support system A finds utility as a support for individuals who have skin disorders requiring ventilation of the skin. In view of the capacity of its cushion B to distribute body weight uniformly over the body area in contact with it, it is particularly suited for an individual who is incapacitated in one manner or another and thus must remain in the same position over relatively long periods of time.

Of course, to prepare the support system A for that individual, the manifold module C is placed upon the underlying surface E, which may be the top surface of a mattress or chair seat, such that the distributor 20 rests on that surface while the duct 30 extends laterally over it and then downwardly beyond the edge of the surface (FIG. 1). The cushion B is then placed over the distributor 20 with its cells 4 presented upwardly and its base 2 centered with respect to the distributor 20. The cushion base 2, being larger than the distributor 20, drops downwardly along its periphery, and contacts the underlying surface E, establishing a seal with the standard mattress and the surface E as well. A portion of the cushion base 2 also extends over the horizontal section 32 of the duct 30 where it effects a seal with the upper wall of that section. The remainder of the cushion base 2 rests on the blunt ends of the pillars 24 which support it in an elevated position above distributor base 22. The space F between the cushion base 2 and the distributor base 22, being thus sealed, is isolated from the surrounding region along the underlying surface E. That space F constitutes the distribution chamber 28. In addition, the hose 38 is connected between the blower and inlet port on the duct 30.

The cells 4 of the cushion B are inflated—indeed overinflated—by opening the valve in the stem 12 and blowing air into the cushion B. When an individual sits or reclines upon the cushion, the valve is opened to allow some of the entrapped air to escape through the stem 12. The air cells 4 deflate and the individual sinks farther into the cushion B. The closed upper ends of the air cells 4 bear against the individual's body and form a supporting surface which conforms to every contour of that much of the individual's body which is in contact with the supporting surface. When the upper ends of those cells 4 which experience the greatest deflection come within a half inch of the cushion base 2, the valve is closed. Since the interiors of the air cells 4 are in communication through the channels 10, those interiors exist at the same pressure, and each cell 4, accordingly, exerts the same restoring force on the individual's body irrespective of how greatly the cell 4 is deflected. In other words, the supporting force per unit area is uniform over that much of the individual's body which is in contact with the cushion B. This feature greatly reduces the incidence of decubitus ulcers.

If the individual's skin requires ventilation or heating or cooling, the blower D is provided and the conditioning means 45 is energized. The blower D forces air into the hose 46 and through the duct 30, whereupon the air discharges into the distribution chamber 28 formed about the posts 24 of the distributor 20. Since the peripheral portion of the cushion base 2 establishes a seal with the rim 26 and the top of the duct 30, as well as with the underlying surface E, most of the air that is forced into the distribution chamber 28 escapes through the apertures 14 in the overlying base 2 of the cushion B. This air rises through whatever gaps exist between adjacent air cells 4, and leaves the cushion at the upper ends of the air cells 4. As it escapes, it passes along that portion of the individual's body which is against cushion B and, thus, provides a measure of ventilation, heating or cooling. Blower C may also be a vacuum device to cause room air to be passed over the person.

Should a body liquid, such as urine, be discharged onto the cushion B, it will pass between adjacent cells 4 and thence through the apertures 14 into the distribution chamber 28. The rim 26 of the distributor 20 keeps the liquid on the distributor base 22, from which it passes into the duct 30, flowing first through the horizontal section 32 and thence the vertical section 34 and the vertical duct 40 which terminates at the container 42 where the liquid collects. The rim 26 does not have to be integral and it can be a separate pan.

Modification of the Invention

Figure 6:
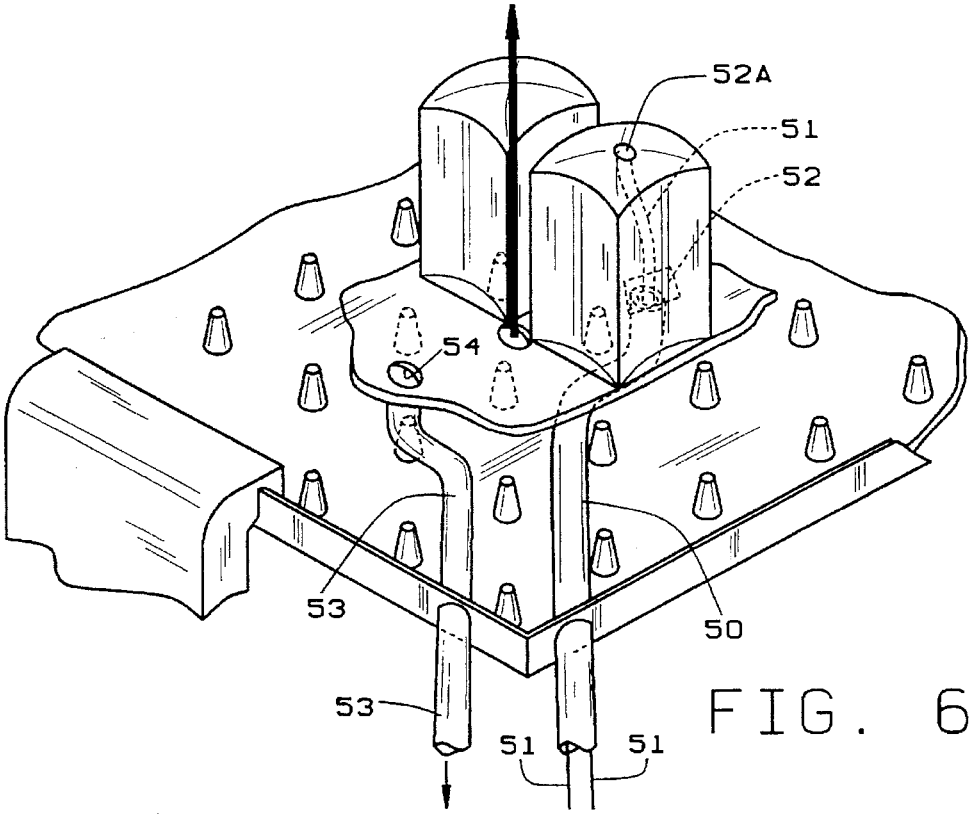
FIG. 6 is a fragmentary perspective view of a modification of this invention.

FIG. 6 shows a modification of the invention in which access to the individual air cells 4 is provided by tubes 50 which extend from the exterior of the distributor 20 through the rims 26 to the cells 4. The tubes 50 provide pneumatic or electrical communication to an individual cell so that the physiological conditions of the patient on the cushion B can be monitored. Also, the temperature, pulse, or body movement of the patient at the location of the cell 4 can be measured through the tubes 50. Electrical wires 51 in the tubes 50 connect a device 52 for measuring temperature or pressure is located in the cell 4 with a remote monitor (not shown), where the desired data is collected and recorded. Another form of temperature sensor 52*a* may be attached to the outside of the cell 4. The sensor 52*a* also can be attached to the inside of the top of the cell 4. The pressure sensor 52 is responsive to body movements such as respiration, static, and blood pressure pulse.

FIG. 6 also shows an access tube 53 which is connected to a drain hole 54 in the mattress base 2 for draining urine or other body fluid from the mattress B. The tube 53 also passes from the drain hole 54 in the mattress base 2 into the distributor 20 and out through the rim 26, when provided.

Access to the patient on the air cells 4 for catheter urine collection, intravenous feeding, or instrumentation sensors can be had through tubes or wires similar to the tubes 50,53 which pass from outside the distributor 20 through the rim 26 and the openings 54 in the cushion B to the patient on the cushion B.

Figure 7:
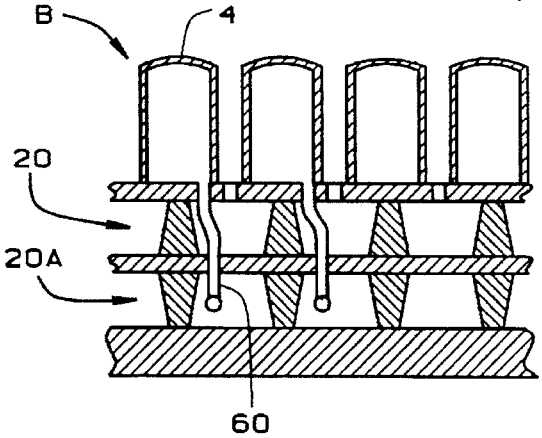
FIG. 7 is a partial vertical sectional view of another modification of this invention.

Still another modification of the invention is shown in FIG. 7 in which the cushion or mattress B is placed on a set of distributors 20,20A. In this arrangement, the top distributor 20 (which is immediately below and directly beneath the cushion B), is used to provide conditioned air and fluid relief to the cushion B. Immediately below the distributor 20 is a second inverted distributor 20A which provides a second layer of mechanical space for access to the cushion B for tubing and/or wire. This arrangement separates the air and/or fluid flow and access to the cushion B from the pneumatic and/or electrical access to the cushion. In the construction of FIG. 7, the tubes 60 provide pneumatic and electrical access to the air cells 4.

This invention is intended to cover all changes and modifications of the example of the invention herein chosen for purposes of the disclosure which do not constitute departures from the spirit and scope of the invention.

What is claimed is:

1. A support system for supporting a patient comprising a. an independent cushion for supporting a patient, said cushion having a flexible fluid impervious base, b. a series of spaced apertures in the base, c. a separate open top distributor member comprising a base member, upstanding side edges on the base and a series of spaced upstanding pillars positioned on the base, said pillars engaging and supporting the flexible base of the cushion above the base of the distributor member, the side edges sealingly engaging the underside of the flexible cushion base, whereby the distributor base, side edges and pillars, with the cushion base define a distribution and access chamber, and d. means for communicating with the patient from a remote location through the distribution chamber and the base apertures.

2. The support system of claim 1 including means for providing conditioned air to the patient through the distribution chamber and the cushion base apertures.

3. The support system of claim 1 including a second distribution chamber beneath the base whereby means for measuring patient physiological characteristics are separated from patient treatment and patient body fluid collecting activities.

4. A support system for supporting a patient on an underlying surface, said system comprising an independent cushion for supporting a patient, said cushion having a flexible base provided with apertures which pass through the flexible base, a separate independent distributor located beneath the base of the cushion and positionable on said underlying surface, said cushion and distributor being separable from each other to facilitate individual cleaning, said distributor including a base and upstanding pillars which engage and elevate the base of the cushion above the base of the distributor, the flexible base of the cushion and the distributor defining a distribution chamber beneath the base of the cushion, a duct having one end remote from the distributor and its opposite end opening into the distribution chamber, and an air mover connected to the duct for moving air through it, whereby the air flows through the duct and the distribution chamber and through the apertures in the cushion base so as to pass over that portion of the patient which is against the cushion.

5. The support system of claim 4 wherein the air is conditioned before it reaches the patient.

6. A support system according to claim 4 wherein the cushion further includes a plurality of air cells which project outwardly from the base, wherein at least some of the cells have their interiors in communication through the base so that the interiors of those cells exist at the same pressure, and wherein the apertures in the base are located between the cells.

7. A support system according to claim 4 wherein the pillars are positioned such that they do not coincide with the apertures through the cushion base.

8. A support system according to claim 7 wherein the base of the distributor means is smaller than the flexible base of the cushion so that the cushion base projects beyond the distributor and forms a seal with the surface.

9. A support system according to claim 8 wherein the duct opens into the distribution chamber of the base of the distribution means, and where the height of the duct generally does not exceed the height of the pillars.

10. A support system according to claim 8 wherein the distributor means resembles a pan and has a rim which projects upwardly and engages the underside of the base to retain fluids.

11. A support according to claim 8 wherein the cushion further includes a plurality of air cells which project outwardly from the base, wherein at least some of the cells have their interiors in communication through the base so that the interiors of those cells exist at the same pressure, and wherein apertures in the base are located between the cells.

12. The system of claim 4 wherein the cushion is comprised of a series of spaced air cells connected to the base and upstanding therefrom and including a temperature sensor attached to the top of at least one of the air cells.

13. The system of claim 12 wherein the temperature sensor is attached to the inside of the top of the air cell.

14. The system of claim 12 wherein the temperature sensor is attached to the outside of the top of the air cell.

15. The system of claim 4 wherein the cushion is comprised of a series of air cells and including means within at least some of the cells for measuring the pressure changes in said individual air cell.

16. The system of claim 4 including a post insert in the duct to keep it from collapsing.

17. In combination with a generally horizontal surface, a system for supporting an individual above that surface while circulating air along the downwardly presented skin area of that individual, said system comprising a distributor having a base which rests on the surface and studs projecting upwardly from the base, a cushion located over the distributor and having a flexible base and a plurality of flexible air cells projecting outwardly from the base, the cushion for the most part resting on the posts of the distributor so that a distribution access chamber exists between the distributor base and the cushion base, but being larger than the distributor so that a peripheral portion of the cushion rests on the supporting surface, the interiors of at least some of the air cells of the cushion being in communication through the cushion base so that the interiors of those cells exist at the same pressure when an individual is upon the cushion, the cushion base having apertures located in the air cells, a duct connected to the distributor and opening into the distribution chamber, and a blower connected to the duct remote from the distributor for supporting air or suction to the distributor chamber, whereby the air escapes through the apertures in the cushion base and circulates along the downwardly presented skin area of the individual supported on the cushion.

18. The combination according to claim 17 wherein the height of the duct where the duct opens into the distribution chamber is no greater than about the height of the studs.

19. The combination according to claim 17 wherein the duct has a horizontal section extended along the supporting surface and a vertical section which extends downwardly from the horizontal section beyond the supporting surface, and further comprising a container attached to the vertical section at its lower end for collecting liquids.

20. The combination according to claim 17 wherein the distributor includes a rim which extends generally around the base of the distributor and forms a seal with the overlying cushion base.

21. A support system for supporting a patient comprising a. a cushion for supporting a patient, said cushion having a flexible base, b. apertures through the base, c. a distributor beneath the cushion base and supporting the cushion, the distributor defining a distribution and access chamber beneath the cushion, d. a remote monitoring system, and e. tubes connecting the cushion to said remote monitoring system through the distribution chamber and the cushion base apertures.

22. A support system for supporting a patient, said system comprising an underlying surface, a cushion having a flexible base provided with apertures, distributor means having a base positioned on said underlying surface and a plurality of pillars which project upwardly from the distributor base and support the cushion base above the underlying surface so as to create a distribution chamber beneath the base of the cushion, a duct having one end remote from the distributor means and its opposite end opening into the distribution chamber at the distributor means, and an air mover connected to the duct for moving conditioned air through said duct, whereby the conditioned air flows through the duct and the distribution chamber and through the apertures in the cushion base so as to pass over that portion of the patient which is against the cushion, the base of the distributor means being smaller than the flexible base of the cushion so that the cushion base projects beyond the distributor and forms a seal with the surface and the duct includes a horizontal section that extends along the underlying surface and leads up to the distributor means and a vertical section which is located beyond the underlying surface and extends downwardly from the horizontal section, and further comprising a container coupled to the vertical section at the lower end thereof for collection of liquids.

23. A support system according to claim 22 and further comprising a rim located along the periphery of the base for the distributor means for retaining liquids that seep through the apertures in the cushion base on the base of the distributor means.

24. A support system according to claim 22 wherein the air mover is a blower which discharges conditioned air into the vertical section of the duct.

* * * * *